US007987755B2

(12) United States Patent
Van Heck et al.

(10) Patent No.: US 7,987,755 B2
(45) Date of Patent: Aug. 2, 2011

(54) DEVICE FOR FORMING SLEEVE-LIKE FOIL ENVELOPES

(75) Inventors: Marinus Antonius Leonarda Van Heck, Uden (NL); Henricus Petrus Hubertus Van Der Zanden, Milheeze (NL)

(73) Assignee: Fuji Seal International Inc. (JP)

( * ) Notice: Subject to any disclaimer, the term of this patent is extended or adjusted under 35 U.S.C. 154(b) by 28 days.

(21) Appl. No.: 11/784,930

(22) Filed: Apr. 10, 2007

(65) Prior Publication Data

US 2007/0240549 A1 Oct. 18, 2007

(30) Foreign Application Priority Data

Apr. 13, 2006 (NL) ..... 1031597

(51) Int. Cl.
*B26D 1/56* (2006.01)
*B26D 5/38* (2006.01)
*B26D 7/06* (2006.01)

(52) U.S. Cl. ..... 83/286; 83/371; 83/303; 83/438

(58) Field of Classification Search ..... 83/371, 83/445, 436.7, 303, 438, 447, 448, 861, 875, 83/76, 285–292, 300; 264/138, 145, 148, 264/150, 157, 159
See application file for complete search history.

(56) References Cited

U.S. PATENT DOCUMENTS 3,304,820 A * 2/1967 Muller et al. ..... 83/25
3,347,119 A * 10/1967 Sarka ..... 83/38
3,448,646 A * 6/1969 Bishop ..... 83/303
3,542,618 A * 11/1970 Devaughn ..... 156/250
4,098,158 A * 7/1978 Escales et al. ..... 83/27
4,277,594 A * 7/1981 Matthews et al. ..... 526/352
4,361,260 A * 11/1982 Hanlan ..... 226/30
4,384,500 A * 5/1983 Friberg ..... 83/74
4,519,868 A * 5/1985 Hoffmann ..... 156/353
4,719,575 A * 1/1988 Gnuechtel ..... 700/122
4,737,904 A * 4/1988 Ominato ..... 700/58
4,869,863 A * 9/1989 Iwai et al. ..... 264/564
4,955,265 A * 9/1990 Nakagawa et al. ..... 83/74
5,241,884 A * 9/1993 Smithe et al. ..... 83/76
5,286,317 A * 2/1994 Treat et al. ..... 156/64
5,470,300 A * 11/1995 Terranova ..... 493/11
5,586,479 A * 12/1996 Roy et al. ..... 83/74
5,709,932 A * 1/1998 Glez et al. ..... 428/220
5,735,785 A * 4/1998 Lucas et al. ..... 493/34
5,740,709 A * 4/1998 Boston et al. ..... 83/308
5,777,879 A * 7/1998 Sommerfeldt ..... 700/125
5,791,220 A * 8/1998 Liao ..... 83/364

(Continued)

FOREIGN PATENT DOCUMENTS

EP 0338260 10/1989

(Continued)

*Primary Examiner* — Sean Michalski
(74) *Attorney, Agent, or Firm* — Olson & Cepuritis, Ltd.

(57) ABSTRACT

A device for forming envelopes from a continuous flat strip of a sleeve-like foil material, comprising a supply member, a cutting member for making a cut over the full width of the material so as to provide individual envelopes, and a discharge member for discharging the envelopes. The cutting member comprises at least two cutting elements movable relative to the strip of material, each cutting element comprising at least one cutting blade extending parallel to the width of the strip, such that the individual cutting blades form several partial cuts contiguous to each other in the foil material over the width thereof in successive cutting operations.

19 Claims, 5 Drawing Sheets

U.S. PATENT DOCUMENTS

| | | | | |
|---|---|---|---|---|
| 5,799,556 | A * | 9/1998 | Straub | 83/82 |
| 5,826,411 | A * | 10/1998 | Butturini | 53/557 |
| 6,160,609 | A * | 12/2000 | Inoue | 355/41 |
| 6,289,777 | B1 * | 9/2001 | Hartmann et al. | 83/30 |
| 7,028,598 | B2 * | 4/2006 | Teshima | 83/879 |
| 7,121,177 | B2 * | 10/2006 | Hatano | 83/13 |
| 7,182,007 | B2 * | 2/2007 | Berge et al. | 83/13 |
| 7,207,249 | B1 * | 4/2007 | Smith | 83/13 |
| 7,255,030 | B2 * | 8/2007 | Benjaminsson | 83/13 |
| 7,430,948 | B2 * | 10/2008 | De Marco et al. | 83/236 |
| 7,484,445 | B2 * | 2/2009 | De Marco et al. | 83/342 |
| 2003/0033915 | A1 * | 2/2003 | Glemser et al. | 83/26 |
| 2004/0173073 | A1 * | 9/2004 | Wilkes | 83/371 |
| 2004/0182211 | A1 * | 9/2004 | Maddalon | 83/74 |
| 2006/0174738 | A1 * | 8/2006 | Hatano | 83/13 |

FOREIGN PATENT DOCUMENTS

| | | | |
|---|---|---|---|
| EP | 0 368 663 | * | 5/1990 |
| EP | 0368663 | | 5/1990 |
| EP | 0449006 | | 10/1991 |
| FR | 2738797 | | 3/1997 |
| GB | 2256828 | | 12/1992 |

* cited by examiner

DEVICE FOR FORMING SLEEVE-LIKE FOIL ENVELOPES

The present invention relates to a device for forming sleeve-like foil envelopes from a continuous flat strip of a sleeve-like foil material, comprising a supply member for supplying the continuous flat strip of sleeve-like foil material, a cutting member for making a cut in the strip of sleeve-like foil material over the full width thereof so as to obtain the individual sleeve-like foil envelopes and a discharge member for discharging the individual sleeve-like foil envelopes from the device.

A related device is, for example, disclosed in European Patent Publication No. 0 805 110. With that device, individual sleeve-like foil envelopes are formed in one cutting motion, which individual, flat, sleeve-like foil envelopes must subsequently be opened and be placed around an object, such as a bottle or other container, with a slight oversize. The foil material that is used is made of a so-called "shrink material", which will shrink under the influence of heat being supplied thereto and conform tightly to the shape of the bottle or other container around which the foil envelope has been placed.

In the above European application, the foil envelope is made in the form of a continuous strip wound on a roll, which needs to be cut to the correct length by means of a device as mentioned above. To that end, the cutting member is driven in dependence on the length, in such a manner that the strip of sleeve-like foil material is cut to the correct length, after which the individual sleeve-like foil envelope thus formed is discharged from the device and opened to be subsequently placed around the container in a conventional manner.

A drawback of the device that is currently known is that it is only suitable for use with thick or hard foil materials in order to obtain a high processing rate. When thinner or more flexible foil materials are used, the processing speed must be reduced to prevent the device from becoming jammed.

One benefit of the present invention is to obviate these drawbacks and to provide a device as mentioned above in which large numbers of foil envelopes of varying length and varying types of material can be formed at a high processing rate.

According to the present invention, the device is characterized in that the cutting member comprises at least two cutting elements that are movable relative to the flat strip of sleeve-like foil material, each cutting element comprising at least one cutting blade extending parallel to at least part of the width of the strip, in such a manner that the individual cutting blades of the cutting elements form several partial cuts contiguous to each other in the strip of sleeve-like foil material over the entire width thereof in successive cutting operations.

A problem that frequently occurs when cutting sleeve-like or tubular foil materials by means of rotating cutting blades, in particular at higher speeds, is that the foil edges seal or stick together at the cut surfaces. The sealing occurs in particular when the cutting blades are no longer perfectly sharp, and it occurs more easily when thinner foil types are used. This phenomenon is prevented by forming several contiguous partial cuts in the strip of sleeve-like material over the entire width thereof.

Furthermore, this will prolong the life of the cutting blade, resulting in lower costs for the user.

The processing speed can be increased significantly by forming the cuts in the continuous strip of sleeve-like material in phases, while preventing any jamming or clogging of the device. Furthermore, this construction, in which several partial cuts are formed in succession in the foil material, makes it possible to use thinner foil materials.

In a specific embodiment, the cutting blades of the various cutting elements are arranged in at least partially overlapping relationship adjacent to each other, as a result of which a tight cut is formed over the entire width of the strip, thus making it possible to form individual foil envelopes.

In one embodiment, each cutting element comprises one cutting blade, while in another embodiment at least one cutting element comprises at least two cutting blades.

To realize an effective utilization of the mounting space of the device and to obtain a high processing speed, the cutting elements are arranged some distance apart along the continuous flat strip of sleeve-like foil material, when viewed in the direction of transport of the continuous flat strip of sleeve-like foil material.

The high processing speed can be realized in a functional embodiment of the device according to the present invention in that the cutting elements are each rotatable about an axis parallel to the width of the strip of sleeve-like foil material. This makes it possible to provide a simple and robust construction, which moreover makes it possible to drive the device in a continuous (and reliable) manner at a high processing speed.

More specifically, the cutting elements rotate at identical rotational speeds, while in another embodiment the rotational speed of each cutting element can be varied during one rotation, so that the processing speed can be adapted to, for example, the length of the foil envelopes to be formed, the type of foil material (thickness, etc), and other parameters.

To make a sharp cut at the correct position in the strip of foil material, the rotational speed of each cutting element is substantially identical to the speed of transport of the strip of sleeve-like foil material through the device at the moment when the partial cut is formed.

In a functional embodiment, in order to provide a failure-free passage of the continuous strip of foil material through the device, so that rejects or standstill can be prevented but above all high processing speeds can be achieved, the conveying member includes a guide element over which the strip of sleeve-like foil material can be led during operation.

The guide element may be configured as a flat member in that case.

The continuous strip of foil material is prevented from undesirably getting jammed in the device in that the guide element extends beyond the cutting member, when viewed in the direction of transport of the strip of sleeve-like foil material.

On the other hand, in order to prevent damage to other moving parts in the device, material has been removed from the guide element at the location where the cutting blades of the cutting elements cut through the strip of sleeve-like foil material.

According to the invention, in order to place an originally flat foil envelope over a three-dimensional product, such as a container (a can, jar or bottle) in an effective manner, the device is provided with a spreading element for opening each individual flat sleeve-like foil envelope at a location downstream of the cutting member, when viewed in the direction of transport of the strip of sleeve-like foil material.

To place the originally flat foil envelope over the product, the spreading element is enlarged at least in the plane perpendicular to the plane of the flat strip of foil material. Placement of the envelope over the product can be further improved if in another embodiment the spreading element is enlarged in the plane of the flat strip of foil material.

To make it possible to reset the device according to the invention in a simple manner, the spreading element may be mounted to the guide element.

Furthermore, in order to obtain a more efficient arrangement, a discharge member can be disposed near the spreading element for discharging the individual sleeve-like foil envelopes that have been formed from the device.

In another functional embodiment, the device is provided with at least one sensor, which is arranged for detecting markings provided some distance apart on the continuous strip of sleeve-like foil material and delivering a measuring signal based on the detection. Based on the measuring signal, the cutting member forms partial cuts in the strip of sleeve-like foil material. In this way it is possible to form large numbers of sleeve-like foil envelopes of a specific length.

More specifically, a control member can be provided to control the cutting member based on the measuring signal delivered by the sensor, a specified length of the sleeve-like foil envelopes to be formed and the conveying speed of the strip of sleeve-like foil material.

BRIEF DESCRIPTION OF THE DRAWINGS

The invention is now explained in more detail with reference to the drawings, in which.

DETAILED DESCRIPTION OF PREFERRED EMBODIMENTS

For a better understanding of the invention, like parts will be indicated by identical numerals in the following description of the Figures.

Figure 1:
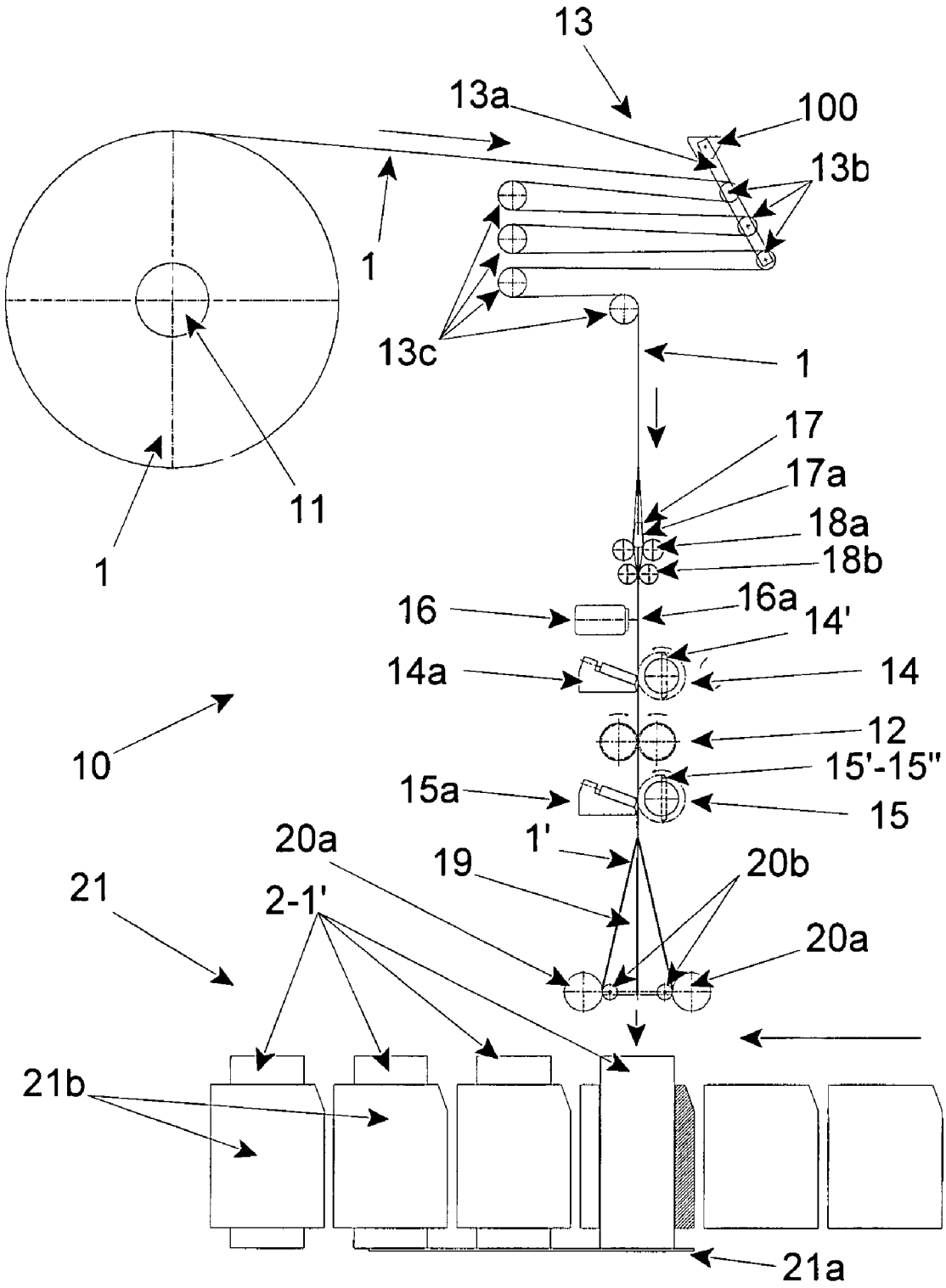
FIG. 1 shows an embodiment of a device according to the invention.

In FIG. 1, numeral 10 indicates a device according to the invention. The device 10 comprises a supply member or moving member 12 made up of two drivable (feed) rollers, between which a continuous strip of foil material 1 can be carried. The continuous strip of foil material 1 is wound on a supply reel 11 and is introduced into the device via a tensioning mechanism 13. The tensioning mechanism 13 has an arm 13*a*, which is pivotally connected to the fixed structure 100. The pivot arm 13*a* comprises several rollers 13*b*, over which the continuous strip of sleeve-like foil material 1 is passed. The strip of sleeve-like foil material 1 is also passed over additional, fixedly disposed rollers 13*c*. In this way it is possible to provide a certain supply of material but also to provide a certain tension of the continuous strip of sleeve-like foil material being unwound from the reel 11.

Figure 2:
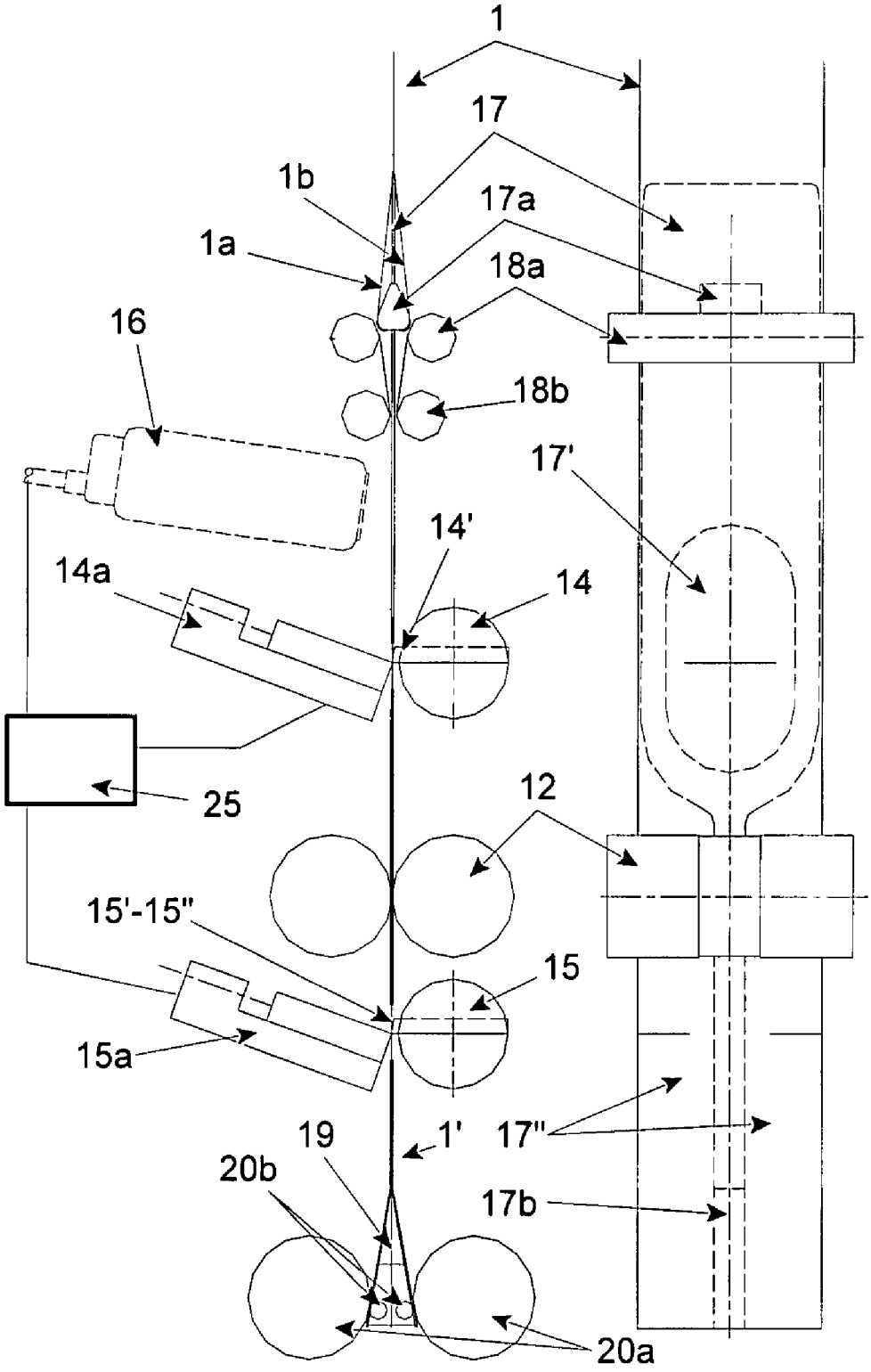
FIG. 2 shows a detail view of the device of FIG. 1.

As FIG. 2 clearly shows, the continuous strip of sleeve-like foil material comprises two strip sides 1*a*, 1*b*, which are connected along at least one longitudinal side, for example, by means of a sealing seam. The foil material is preferably a heat-shrinkable film comprising a plastic, metal-plastic or comparable material.

The supply member 12 carries the continuous strip of sleeve-like foil material 1 past cutting member for cutting the foil material through at predetermined intervals so as to obtain individual sleeve-like foil envelopes. According to the invention and as shown in the Figures, the cutting member is made up of two clamping sections 14-15, which each comprise cutting elements 14-15 that are movable with respect to the flat strip of sleeve-like foil material 1, each cutting element 14-15 being provided with at least one cutting blade 14';15'-15", which extends at least parallel to at least part of the width of the strip of foil material.

Figure 3:
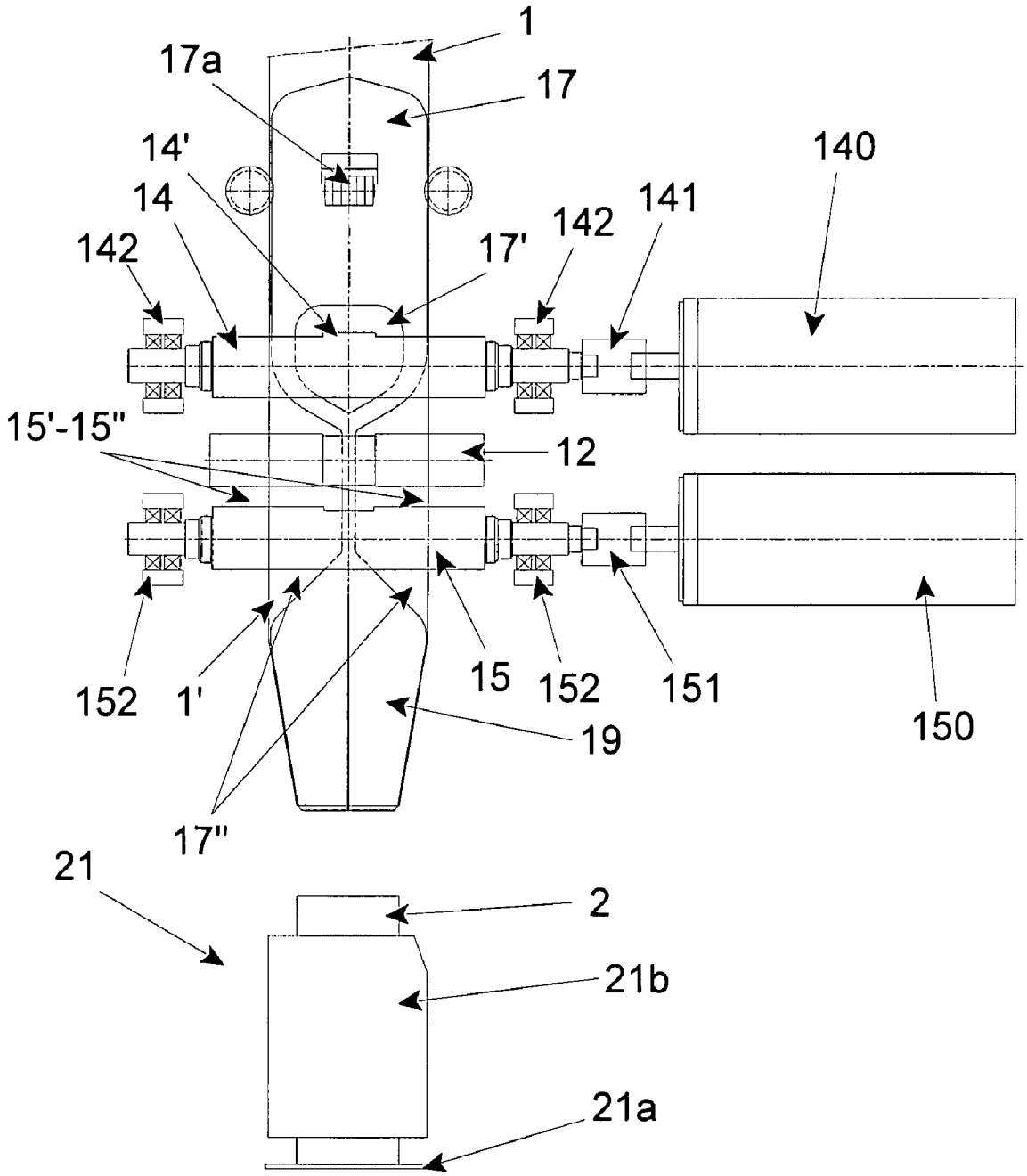
FIG. 3 shows another detail view of the device of FIG. 1.
Figure 4:
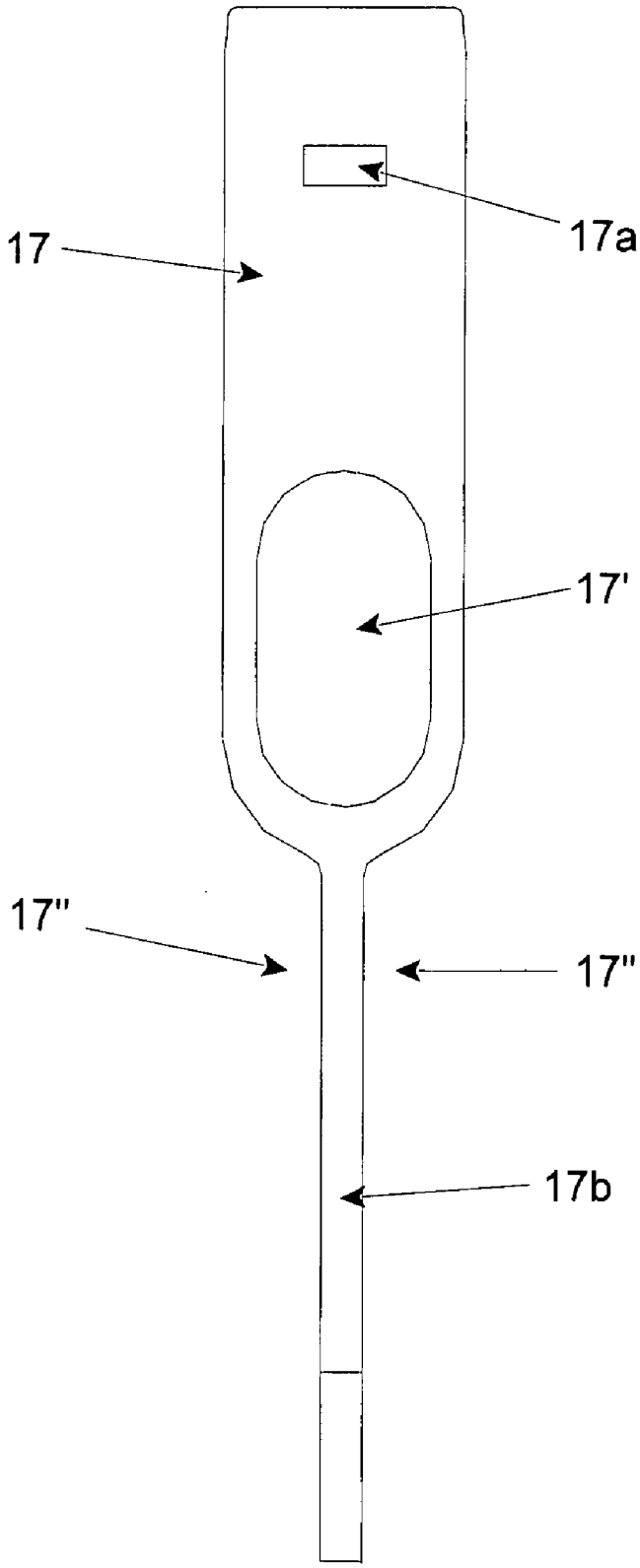
FIG. 4 shows a further detail view of the device of FIG. 1.

In this embodiment, the cutting elements 14-15 are arranged some distance apart along the continuous strip of sleeve-like foil material 1, when viewed in the direction of transport of the continuous strip. The cutting elements 14-15 are each rotatable about their axis parallel to the width of the strip of sleeve-like foil material 1, as shown in FIGS. 2 and 3.

Upon transport of the continuous strip of sleeve-like foil material 1 through the device (by the supply member 12), the two cutting elements 14-15 are driven in such a manner that they successively form partial cuts in the continuous strip of foil material in successive operating steps, which partial cuts will eventually be aligned and be contiguous to each other, thus forming a complete cut for forming an individual sleeve-like foil envelope.

The forming of contiguous partial cuts by two separate cutting elements 14-15 requires a correct adjustment or control of the cutting elements, also taking into account the conveying speed of the continuous strip of sleeve-like foil material 1 through the device.

To that end the device is provided with a sensor 16, which is arranged for detecting markings (not shown) present in or on the continuous strip of foil material 1. The markings are arranged at regular intervals and preferably consist of a strip of foil material which has been made reflective or, in the alternative, a strip of a transparent foil material. In both embodiments the sensor 16 can be configured as a light sensor which detects the presence of a marking on the strip of foil material 1 based on reflected or transmitted light and which is capable of determining the conveying speed, for example, of the strip of foil material 1 through the device on the basis of successive detections. Given a desired length of the individual sleeve-like foil envelopes, the two cutting elements 14-15 are rotatably driven accordingly.

Rotation of the cutting element 14 or 15 places the cutting blade 14' or 15'-15" into abutment against a fixedly disposed anvil 14*a*-15*a*, as a result of which a partial cut is formed in the continuous strip of foil material 1 that is present therebetween.

This is clearly shown in FIG. 3, in which the cutting element 14 has a single cutting blade 14', while the second cutting element 15 is provided with two cutting blades the 15'-15". The cutting blades 14' and 15'-15", respectively, are so arranged on the two cutting elements 14-15 that the cutting blades 14', 15'-15" are contiguous to each other, preferably slightly overlapping each other. In a first operation, a first partial cut is formed in the strip of sleeve-like foil material by the cutting blade 14' through rotation of the first cutting element 14, which strip 1 is moved in the direction of the second cutting element 15 by the supply member 12.

Based on measuring signals delivered by the sensor 16 to a control unit 25 (see FIG. 2), the first cutting element 14 and the cutting blade 14' form a first partial cut in the continuous strip of foil material 1. The strip 1 is moved further by the supply member 12, and the control unit 25 controls the second cutting element 15 in such a manner that the cutting blades 15'-15" are contiguous to the partial cut formed by the cutting blade 14' of the first cutting element 14.

Although the rotational speeds of the cutting elements 14-15 may in principle be the same and be geared to the conveying speed of the strip of foil material and the desired length of the final sleeve-like foil envelopes, the device according to the present invention may be operated at a higher speed by making the rotational speed of each cutting element variable during one rotation.

Furthermore, different rotational speeds may be used for the cutting elements 14-15, while the rotational speed of each cutting element may be substantially equal to the conveying speed of the strip of sleeve-like foil material 1 through the device at the moment of forming the partial cut in order to form good quality and in particular correctly contiguous (or coinciding) cuts. This also depends on the specific properties of the foil material that is used.

Thus, several partial cuts are formed in the continuous strip of sleeve-like foil material 1 in two operations, which partial cuts are contiguous to each other as a result of the two cutting elements 14-15 being suitably controlled, so that a complete cut is formed and an individual sleeve-like foil envelope is formed.

As shown in FIG. 3, the cutting elements 14-15 are rotatably driven by suitable driving members 140-150, which are controlled by the control unit 25. Each cutting element 14-15 is bearing-mounted in the device by means of bearings 142-152 and drivably connected to the driving means 140-150 by means of transmission couplings 141-151.

To prevent undesirable jamming or accumulation of the strip of foil material 1 in the device, a guide element 17 is provided in the device, over which guide element 17 the strip of sleeve-like foil material 1 can be passed. As is clearly shown in FIG. 2, the guide element 17 comprises a support element 17*a* in the shape of a rotatable roller, which is supported by freely rotatable roll pins 18*a*-18*b*, which likewise form part of the device. Thus, the guide element 17 is freely supported in the device by the support rollers 18*a*-18*b*.

The guide element is preferably configured as a flat body having a width substantially equal to the width of the strip of sleeve-like foil material 1. More specifically, the guide element 17 is so constructed that material has been removed from the guide element 17 at the location of the cutting elements 14 and 15 so as to make it possible to form partial cuts in the continuous strip of sleeve-like foil material 1. The locations where material has been removed from the guide element 17 are indicated at 17' in FIGS. 2 and 3 (at the location of the cutting blade 14' of the first cutting element 14) and at 17" (at the location of the two cutting blades 15'-15" of the second cutting element 15).

The free end 17*b* of the guide element 17*a* serves to accommodate a spreading element 19, which functions to open the obtained flat, sleeve-like foil envelopes 1' in order to place the opened, sleeve-like foil envelope around a container (not shown).

As shown in FIGS. 1 and 2 and also in FIG. 3, the spreading element 19 is enlarged at least in the plane perpendicular to the plane of the flat, continuous strip of foil material 1. This is shown in FIGS. 1 and 2. In an improved embodiment, on the other hand, the spreading element may also be enlarged in the plane of the flat strip of foil material, as is shown in FIG. 3. Thus, the flat, sleeve-like foil envelope is opened, so that it can be easily placed around a container 2.

This is shown in FIGS. 1 and 3, which show conveying member 21 provided with a carrier 21*a* with several containers (bottles, jars or cans) present thereon, which containers are carried to the device 10. Each individual, flat, sleeve-like foil envelope is opened by the spreading element 19, after which the sleeve-like foil envelope 1' thus opened can be easily placed around the container 2. The use of so-called vacuum cups 21*b*, as described in European patent publication No. 1 151 847 in the name of the present applicant, can assist in keeping the sleeve-like foil envelope 1' open. The container 2 with the opened sleeve-like foil envelope provided thereon is then subjected to heat treatment, so that the sleeve-like foil envelope shrinks and conforms tightly to the shape of the container 2.

To facilitate the discharge of the individual foil envelope 1' towards the container 2, discharge members 20*a*-20*b* may be provided, which are mounted in the device at the spreading element 19. The discharge members comprise one or more drivable rollers 20*a*, which are supported on the stationary rollers 20*b* and which discharge the sleeve-like foil material 1' present therebetween from the device 10 at an accelerated rate, with the individual, opened foil envelope 1' slipping over a container 2.

Figure 5:
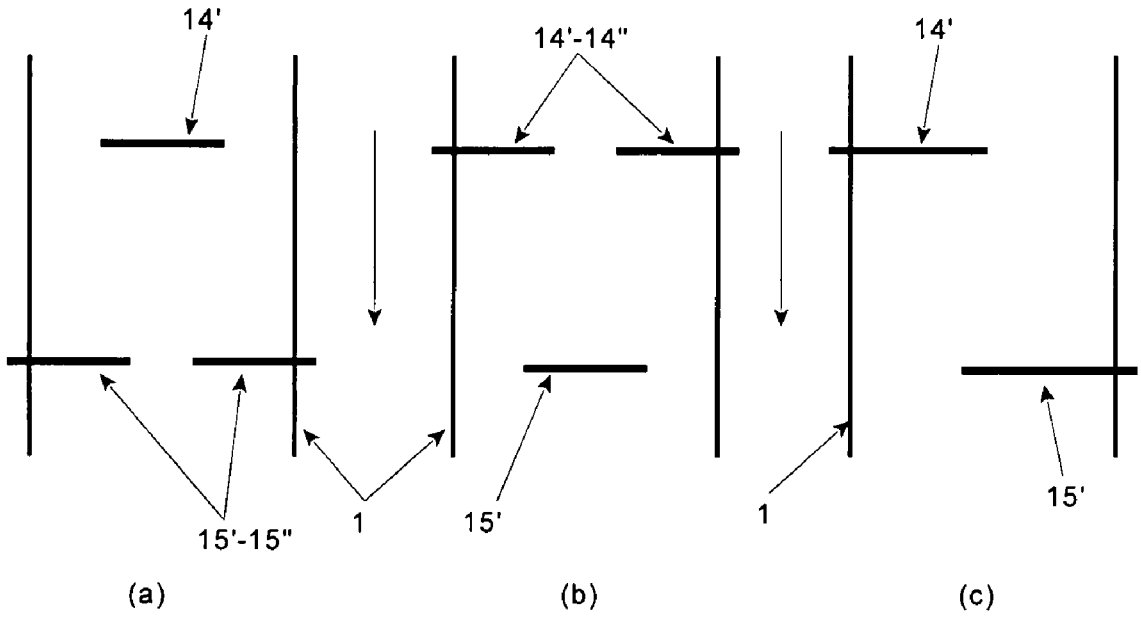
FIGS. 5*a*-5*c* schematically show other embodiments of the device of FIG. 1.

FIGS. 5*a*-5*c* show three further schematic embodiments of the device according to the present invention, specifically relating to the cutting means 14-15.

FIG. 5*a* shows the embodiment as discussed with reference to FIGS. 2 and 3, in which the first cutting element 14 comprises one cutting blade 14', which is oriented approximately centrally relative to the continuous strip of sleeve-like foil material 1. The cutting blade 14' of the first cutting element 14 forms a first partial cut in the first operating step, after which the second cutting element 15 forms further partial cuts contiguous thereto in the foil material 1 on either side of the centrally positioned partial cut by means of two cutting blades 15'-15", so that the continuous strip of sleeve-like foil material 1 is cut through completely so as to obtain an individual sleeve-like foil envelope.

FIG. 5*b* schematically shows another embodiment, in which the first cutting element 14 comprises two cutting blades 14'-14", similar to the second cutting element 15 in FIG. 5*a*. The second cutting element 15 comprises a single cutting blade 15', which is centrally oriented relative to the strip of foil material 1. In this embodiment, two partial cuts 14'-14" are formed in the first operation, which extend through the longitudinal edges of the strip of foil material 1. The cutting of the material is completed by the forming of the partial cut by means of the cutting blade 15' of the second cutting element 15.

In FIG. 5*c*, each cutting element 14-15 comprises a single cutting blade 14'-15', which is disposed to the left and to the right, respectively, (or to the right and to the left, respectively) of the continuous strip of sleeve-like foil material 1.

As is clearly shown and perhaps slightly exaggerated in FIGS. 5*a*-5*c*, the cutting blades 14'-14"-15'-15" are so arranged relative to each other and to the continuous strip of foil material 1 in the device that the partial cuts thus formed partially overlap so as to provide a complete cut through the foil material.

What is claimed is:

1. A device for forming sleeve-like foil envelopes from a continuous flat strip of a shrinkable sleeve-like envelope foil material comprising:

a supply member for supplying the continuous flat strip of shrinkable sleeve-like envelope foil material wherein the continuous flat strip of shrinkable sleeve-like foil envelope material when cut is predisposed to seal together at the cut surfaces;

a cutting member for making a cut in the strip of shrinkable sleeve-like envelope foil material over the full width thereof so as to provide individual sleeve-like foil envelopes, wherein the cut surfaces of the envelope material are unsealed; and a discharge member for discharging the individual sleeve-like foil envelopes from the device, wherein the cutting member comprises at least two cutting elements that are movable relative to the flat strip of shrinkable sleeve-like envelope foil material, each cutting element comprising a cutting blade extending parallel to at least part of the width of the strip, in such a manner that the individual cutting blades of each of the cutting elements cooperate in successive cutting operations to form several partial cuts contiguous to each other in the strip of shrinkable sleeve-like foil envelope material over the entire width thereof;

wherein the device is provided with at least one sensor, which is arranged for detecting markings provided some distance apart on the continuous strip of shrinkable sleeve-like envelope foil material and delivering a measuring signal on the basis of the detection, wherein on the basis of the measuring signal the cutting member forms partial cuts in the strip of shrinkable sleeve-like foil material; and a conveying member comprising a guide element positioned within the strip of shrinkable sleeve-like envelope foil material over which the strip of sleeve-like foil material can be led during operation, wherein the guide element extends beyond the cutting member when viewed in the direction of transport of the strip of sleeve-like foil material; and wherein the guide element has at least two distinct openings formed therein each with a portion of the guide element positioned laterally to the opening, each guide element opening accommodates at least one cutting blade, respectively, during each of said successive cutting operations.

2. The device according to claim 1, wherein the cutting elements are arranged some distance apart along the continuous flat strip of sleeve-like foil material, when viewed in the direction of transport of the continuous flat strip of sleeve-like foil material.

3. The device according to claim 1, wherein the guide element is configured as a flat member.

4. The device according to claim 3, wherein a control member is provided, the control member controlling the cutting member based on the measuring signal delivered by the sensor, a specified length of the sleeve-like foil envelopes to be formed and the conveying speed of the strip of sleeve-like foil material.

5. The device according to claim 1, wherein a control member is provided, the control member controlling the cutting member based on the measuring signal delivered by the sensor, a specified length of the sleeve-like foil envelopes to be formed and the conveying speed of the strip of sleeve-like foil material.

6. The device according to claim 1, wherein the cutting blades of the various cutting elements are arranged in at least partially overlapping relationship adjacent to each other.

7. The device according to claim 6, wherein each cutting element comprises one cutting blade.

8. The device according to claim 6, wherein at least one cutting element comprises at least two cutting blades.

9. The device according to claim 1, wherein the device is provided with a spreading element for opening each individual flat sleeve-like foil envelope at a location downstream of the cutting member, when viewed in the direction of transport of the strip of sleeve-like foil material.

10. The device according to claim 9, wherein the spreading element is enlarged at least in the plane perpendicular to the plane of the flat strip of foil material.

11. The device according to claim 9, wherein the spreading element is enlarged in the plane of the flat strip of foil material.

12. The device according to claim 9, wherein the spreading element is mounted to the guide element.

13. The device according to claim 9, wherein the discharge member is disposed near the spreading element for discharging the individual sleeve-like foil envelopes that have been formed by the device.

14. The device according to claim 1, wherein the cutting elements are each rotatable about an axis parallel to the width of the strip off sleeve-like foil material.

15. The device according to claim 14, wherein the cutting elements rotate at identical rotational speeds.

16. The device according to claim 14, wherein the rotational speed of each cutting element can be varied during one rotation.

17. The device according to claim 14, wherein the rotational speed of each cutting element is substantially identical to the speed of transport of the strip of sleeve-like foil material through the device at the moment when the partial cut is formed.

18. The device according to claim 1, wherein the foil material comprises at least one heat-shrinkable film.

19. The device according to claim 18, wherein the heat-shrinkable film is selected from the group consisting of plastic film and metal-plastic film.

* * * * *

UNITED STATES PATENT AND TRADEMARK OFFICE

CERTIFICATE OF CORRECTION

PATENT NO. : 7,987,755 B2
APPLICATION NO. : 11/784930
DATED : August 2, 2011
INVENTOR(S) : Marinus Antonius Leonarda Van Heck et al.

It is certified that error appears in the above-identified patent and that said Letters Patent is hereby corrected as shown below:

Title page, item [73], Assignee name should be changed from "Fuji Seal International Inc." to --Fuji Seal International, Inc.--

Signed and Sealed this
Twenty-fifth Day of June, 2013

Teresa Stanek Rea
*Acting Director of the United States Patent and Trademark Office*